US006860216B1

(12) United States Patent
Morriseau

(10) Patent No.: US 6,860,216 B1
(45) Date of Patent: Mar. 1, 2005

(54) CANOE PONTOON ASSEMBLY

(76) Inventor: Larry Morriseau, 269 Evergreen Trailer Park, Edmonton, Alberta (CA), T2T 5R6

( * ) Notice: Subject to any disclaimer, the term of this patent is extended or adjusted under 35 U.S.C. 154(b) by 0 days.

(21) Appl. No.: 10/792,752

(22) Filed: Mar. 5, 2004

(51) Int. Cl.[7] ..... B63B 43/14
(52) U.S. Cl. ..... 114/123; 114/347; 114/364
(58) Field of Search ..... 114/123, 347, 114/364

(56) References Cited

U.S. PATENT DOCUMENTS 3,763,813 A * 10/1973 Holtz ..... 114/123
4,512,277 A * 4/1985 Williams ..... 114/364
4,807,551 A * 2/1989 Ace ..... 114/123
6,050,210 A * 4/2000 Grzybowski ..... 114/123
6,305,306 B1 * 10/2001 Grzybowski ..... 114/123

* cited by examiner

*Primary Examiner*—Jesus D. Sotelo

(74) *Attorney, Agent, or Firm*—R. F. Gallagher; G. F. Gallinger

(57) ABSTRACT

Canoes are relatively unstable in as much as they tip over easily. Because of this many side runners have been invented to prevent canoes from tipping over so easily. One problem with all available canoe runners is that they are cumbersome and difficult to transport. On a long journey, more than ever, safety and even survival mandate use of a canoe runner. The problem with all available canoe runners is that they are not sufficiently portable to carry within a canoe for portages which frequently continue for miles. One aspect of this invention provides for a detachable pontoon assembly to prevent a canoe, having opposite upper sidewalls, from capsizing comprises: i) an arm reception member having opposite end portions, each end portion removably attachable to the upper sidewalls in a central portion of the canoe; ii) a lateral arm extending laterally from and adjustably attached to the arm reception member; iii) an upright arm extending downwardly from, and attached to the lateral arm; iv) a saddle attached to a lower end portion of the upright arm; and, v) an inflatable float secured to and positioned beneath the saddle. Whereafter use the float may be deflated and the pontoon assembly broken down for compact storage within the canoe.

20 Claims, 2 Drawing Sheets

CANOE PONTOON ASSEMBLY

FIELD OF THE INVENTION

This invention relates to side runners which are attached adjacent to a canoe, to prevent the canoe from tipping. More particularly this invention relates to a pontoon assembly for a canoe which is uniquely lightweight, quickly detachable and deflatable for portage and storage. The canoe pontoon assembly is adjustable for height and width, and deploys a ballast so that the canoe is stabilized from tipping in both directions with a single side float.

BACKGROUND OF THE INVENTION

One problem with canoes is that they are relatively unstable in as much as they tip over easily. Sudden overbalanced movement by an occupant in the canoe quickly tips and capsizes the canoe. Because of this many pontoon assemblies have been invented to prevent canoes from tipping over so easily. One problem with all available pontoon assemblies is that they are cumbersome. Some are detachable but all are large, unwieldy, and difficult or impossible to dissassemble and transport.

The inventor is an American Indian. He uses canoes extensively for long journeys where he required to portage. When one is more than a day from civilization and shelter, there are many times when a having the canoe capsize can be disastrous. All clothing will be soaked. Many vital supplies may be lost. On a long journey, more than ever, safety and even survival mandate use of a canoe runner. The problem with all available pontoon assemblies for canoes is that they are neither readily detachable, nor are they sufficiently portable to carry within a canoe for portages which frequently continue for miles. A canoe cannot be balanced on one's shoulders when a pontoon projects from one side. Nor, can a canoe cannot be carried through bush when pontoons project outwardly and catch in the bush.

OBJECTS OF THE INVENTION

It is an object of this invention to disclose a portable pontoon assembly for a canoe. This pontoon assembly should be sufficiently portable to be carried within a canoe to a body of water or between bodies of water in a long portage. The disclosed pontoon assembly is detachable, and may easily disassembled and deflated so that it may be carried strapped within a canoe under the seats. Even a child may dissassemble and reassesemble the canoe runner. It is an object of this invention to disclose a canoe runner which may be readily removed from the sidewall of a canoe so that a central portion of the canoe may be carried while balanced on one's shoulders for extended distances. It is an object of this invention to disclose a canoe pontoon assembly having a quickly detachable pontoon which includes a loose peripheral rope so that the pontoon may be removed and provide buoyancy to a capsized canoer. It is yet a further object of this invention to disclose a deflatable and collapsible float for a pontoon assembly in a canoe which may be stored beneath the seats in a bottom portion of the canoe. It is yet a further object of this invention to disclose a method of stabilizing a canoe with a single side float to prevent the canoe tipping to either side. It is yet a further object of this invention to disclose a pontoon assembly for a canoe which is readily adjustable for height to accommodate varying loads within a particular canoe as well as different canoes having varying heights. It is a final object of this invention to disclose a pontoon assembly for a canoe which is adjustable in width to provide varying degrees of stability and maneuverability through narrow passages.

One aspect of this invention provides for a detachable pontoon assembly to prevent a canoe, having opposite upper sidewalls, from capsizing comprises: i) an arm reception member having opposite end portions, each end portion removably attachable to the upper sidewalls in a central portion of the canoe; ii) a lateral arm extending laterally from and adjustably attached to the arm reception member; iii) an upright arm extending downwardly from, and attached to the lateral arm; iv) a saddle attached to a lower end portion of the upright arm; and, v) an inflatable float secured to and positioned beneath the saddle. Whereafter use the float may be deflated and the pontoon assembly broken down for compact storage within the canoe.

In a preferred aspect of this invention a method of stabilizing a canoe having opposite upper sidewalls comprises: i) providing a pontoon assembly having an arm reception member having opposite end portions, a lateral arm to extend outwardly from the arm reception member, an upright arm to adjustably attach to and extend down from the lateral arm, a saddle attached to a lower end portion of the upright arm, and, an inflatable float secured to and positioned beneath the saddle; ii) inflating the float beneath the saddle; iii) attaching the saddle to the upright arm; iv) removably attaching each end portion of the arm reception member to the upper sidewalls in a central portion of the canoe; v) outwardly extending the lateral arm; vi) attaching and adjusting for height the upright arm on the lateral arm. The canoe is stabilized by the float therealong. After use the float is deflated and the pontoon assembly is taken apart, so that the assembly, is storable within the canoe.

Various other objects, advantages and features of this invention will become apparent to those skilled in the art from the following description in conjunction with the accompanying drawings.

FIGURES OF THE INVENTION

Figure 1:
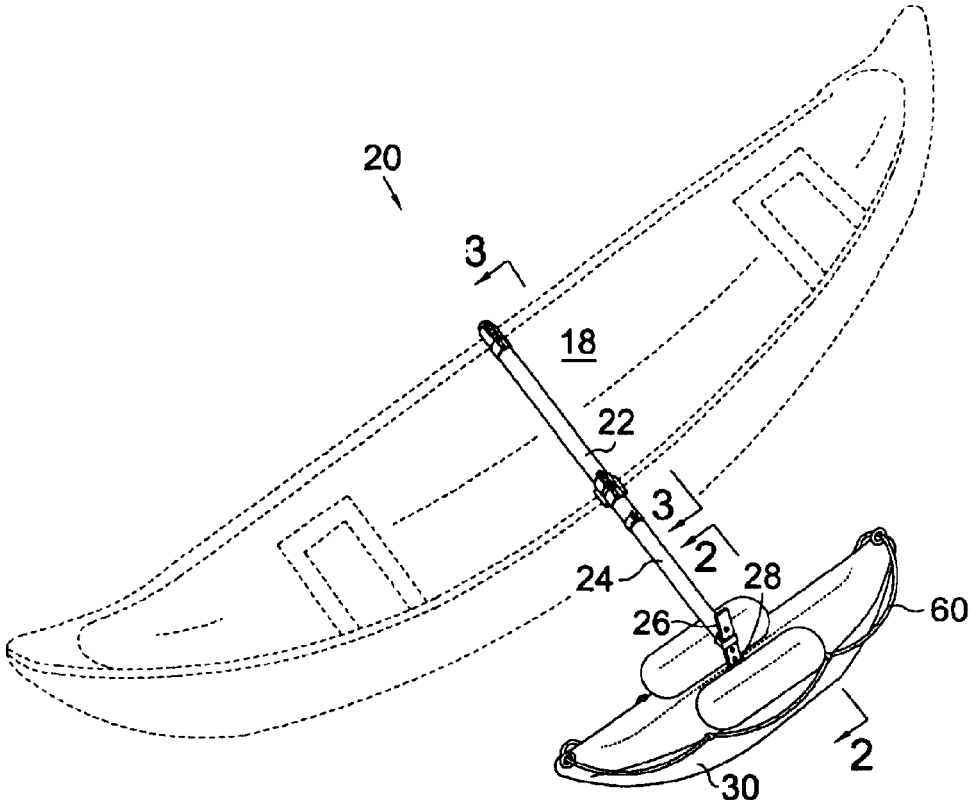
FIG. 1 is a perspective view showing a top and side portion of a canoe having a pontoon assembly mounted thereon for stability.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a perspective view showing a top and side portion of a canoe 18 having a pontoon assembly 20 mounted thereon for stability. A detachable pontoon assembly 20 to prevent a canoe 18, having opposite upper sidewalls 16, from capsizing comprises: i) an arm reception member 22 having opposite end portions, each end portion removably attachable to the upper sidewall 16 in a central portion of the canoe 18; ii) a lateral arm 24 extending laterally from and adjustably attached to the arm reception member 22; iii) an upright arm 26 extending downwardly from, and attached to the lateral arm 24; iv) a saddle 28 attached to a lower end portion of the upright arm 26; and, v) an inflatable float 30 secured to and positioned beneath the saddle 28. After use the float 30 may be deflated and the pontoon assembly 20 broken down for compact storage within the canoe 18.

Figure 2:
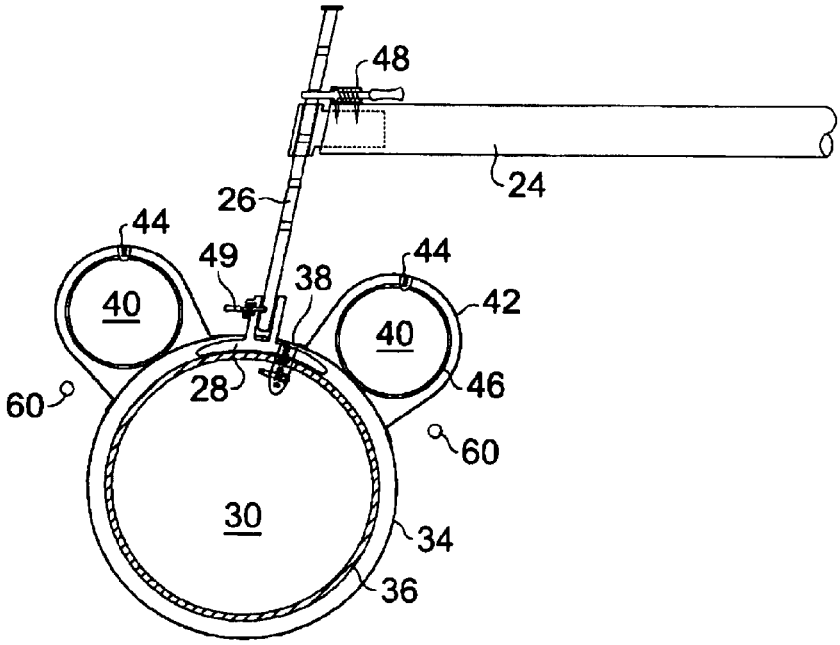
FIG. 2 is a partial cross sectional view of the float in the pontoon assembly, as shown on FIG. 1 along line 2—2.
Figure 3:
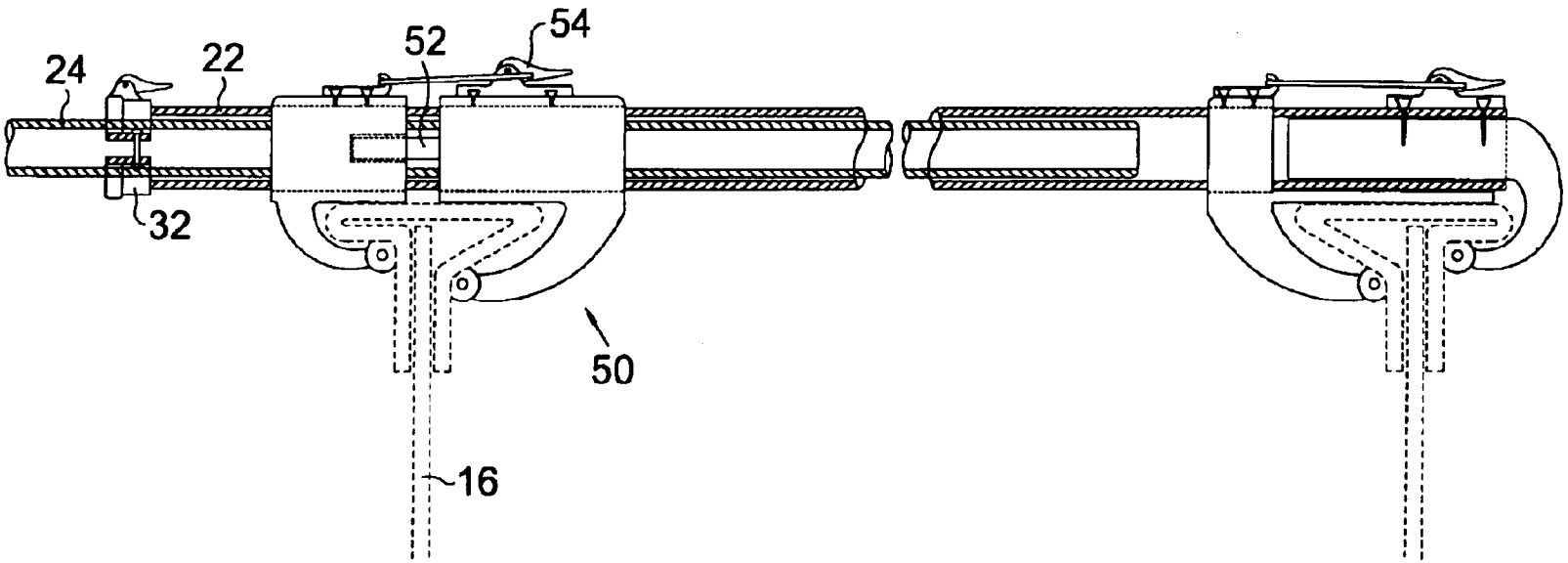
FIG. 3 is a partial cross sectional view of a portion of the pontoon assembly which is directly mounted on the canoe, as viewed in FIG. 1 along line 3—3.

FIG. 2 is a partial cross sectional view of the float 30 in the pontoon assembly 20, as shown on FIG. 1 along line 2—2. The upright arm 26 is adjustably attached to the lateral arm 24 so that the downward extension thereof may be adjusted. FIG. 3 is a partial cross sectional view of a portion of the pontoon assembly 20 which is directly mounted on the canoe 18, as viewed in FIG. 1 along line 3—3. Most preferably the lateral arm 24 is tubular and telescopes outwardly from the arm reception member 22 which further comprises a releasable clamp 32 to maintain the lateral arm 24 at a selected extension, whereby facilitating outward adjustment of the float 30 for increased stability and inward adjustment for increased maneuverability.

In a preferred aspect of this invention the inflatable float 30 comprises a non-elastic foldable shell 34 and an inner bladder 36 so that the float 30 will have a defined and rigid shape when the bladder 36 is inflated. In the most preferred aspect of this invention the bladder 36 of the inflatable float 30 comprises a reclosable opening 38, and wherein the bladder 36 comprises rubber. The reclosable opening 38 may utilize a zipper or VELCRO™ attachment.

In the most preferred aspect of this invention there is one and only one lateral arm 24 extending from the arm reception member 22, and the pontoon assembly 20 further comprises a ballast container 40, carried by the lateral arm 24. Sudden tipping of the canoe 18, about a longitudinal axis, in a rotational direction opposite to the float 30 must then concurrently lift the ballast container 40.

In a preferred aspect of this invention the ballast container 40 is carried above and on an outer side portion of the saddle 28. To provide balanced downward force on the pontoon 30 a second ballast container 40 may be provided. Most preferably, the ballast container 40 comprises a non-elastic foldable shell 42 having a reclosable opening 44 and an inner bladder 46. The ballast container will then have a defined and rigid shape when the bladder 46 is filled. It should be noted that it is intended that the ballast bladder 46 be filled with water.

In the most preferred aspect of this invention the upright arm 26 extending downwardly from the lateral arm 24 has an adjustment therebetween comprising a quick release sprung pin 48 to optimize float 30 height with different loads. For convenience, the saddle 28 is also detachable from the upright arm 26 with a quick release comprising a sprung pin 49.

As best seen in FIG. 1, the float 30 further comprises a safety rope 60 intermittently attached around a periphery of a top portion of the float 60 to facilitate holding the float 60 in the event of a capsize. It is contemplated that if the canoe 18 were not able to be turned over in the water that the float 30 could be released, and an individual could swim to shore while holding the rope 60 on the float 30.

Referring again to FIG. 3, a partial cross sectional view of a portion of the pontoon assembly 20 which is directly mounted on the canoe 18, we see that the arm reception member 22 comprises two clamps 50, each clamp 50 clamping on and over one of the upper sidewalls 16 in a central portion of the canoe 18. In a preferred aspect of this invention each clamp 50 has opposite side portions which are pinned 52 and then buckled 54 together.

With no intention to limit the generality of the description above and the claims, it is suggested that the float be approximately 36" long and 9" in diameter. A 20" zipper (or VELCRO™ strip) is used on the float 30. On each side of the zipper 2 ballast containers 60 are sewn. The saddle base 28 squeezes between the non elastic foldable shell 34 and the bladder 30. A top portion of the saddle base 28 is approximately 2" long×½" wide×3" high. This top portion of the saddle base 28 receives the upright rod which is approximately 8" in length. The lateral arm is approximately 43" in length. It may be made from tube or alternatively a lightweight rigid composite material. The arm reception member 22 may similarly be made of a composite material. The clamps 50 have rubber canoe 18 contacting portions.

A general method of stabilizing a canoe 18 having opposite upper sidewalls 16 comprises the steps of: i) providing a pontoon assembly 20 having an arm reception member 22 having opposite end portions, a lateral arm 24 to extend outwardly from the arm reception member 22, an upright arm 26 to adjustably attach to and extend down from the lateral arm 24, a saddle 28 attached to a lower end portion of the upright arm 26; and, an inflatable float 30 secured to and positioned beneath the saddle 28; ii) Inflating the float 30 beneath the saddle 28; iii) attaching the saddle 28 to the upright arm 26; iv) removably attaching each end portion of the arm reception member 22 to the upper sidewalls 16 in a central portion of the canoe 18; v) outwardly extending the lateral arm 24; and, vi) attaching and adjusting for height the upright arm 26 on the lateral arm 24. The canoe 18 is then stabilized by the float 30 therealong, After use the float 30 is deflated, the pontoon assembly 20 is taken apart, and stored within the canoe 18.

The general method of stabilizing a canoe 18 may be specifically limited by inclusion of the apparatus limitations as specified above.

While the invention has been described with preferred specific embodiments thereof, it will be understood that this description is intended to illustrate and not to limit the scope of the invention, which is defined by the following claims.

I claim:

1. A detachable pontoon assembly to prevent a canoe, having opposite upper sidewalls, from capsizing comprising:

an arm reception member having opposite end portions, each end portion removably attachable to the upper sidewalls in a central portion of the canoe;

a lateral arm extending laterally from and adjustably attached to the arm reception member;

an upright arm extending downwardly from, and attached to the lateral arm;

a saddle attached to a lower end portion of the upright arm; and, an inflatable float secured to and positioned beneath the saddle;

whereafter use the float may be deflated and the pontoon assembly broken down for compact storage within the canoe.

2. A detachable pontoon assembly as in claim 1 wherein the upright arm is adjustably attached to the lateral arm so that the downward extension thereof may be adjusted.

3. A detachable pontoon assembly as in claim 2 wherein the lateral arm is tubular and telescopes outwardly from the arm reception member member which further comprises a releasable clamp to maintain the lateral arm at a selected extension, whereby facilitating outward adjustment of the float for increased stability and inward adjustment for increased maneuverability.

4. A detachable pontoon assembly as in claim 1 wherein the inflatable float comprises a non-elastic foldable shell and an inner bladder so that the float will have a defined and rigid shape when the bladder is inflated.

5. A detachable pontoon assembly as in claim 4 wherein the non-elastic foldable shell comprises a nylon fabric having a reclosable opening, and wherein the bladder comprises rubber.

6. A detachable pontoon assembly as in claim 5 wherein there is one and only one lateral arm extending from the arm reception member, and further comprising a ballast container, carried by the lateral arm, to resist sudden tipping of the canoe concurrent with lifting of the ballast container.

7. A detachable pontoon assembly as in claim 6 wherein the ballast container is carried above and on an outer side portion of the saddle.

8. A detachable pontoon assembly as in claim 7 wherein the ballast container comprises a non-elastic foldable shell having a reclosable opening and an inner bladder, so that the ballast container will have a defined and rigid shape when the bladder is filled.

9. A detachable pontoon assembly as in claim 1 wherein the arm reception member comprises two clamps, each clamp clamping on and over one of the upper sidewalls in a central portion of the canoe.

10. A detachable pontoon assembly as in claim 9 wherein each clamp has opposite side portions which are pinned and buckled together.

11. A detachable pontoon assembly as in claim 10 wherein the upright arm extending downwardly from the lateral arm has an adjustment therebetween comprising a quick release sprung pin to optimize float height with different loads.

12. A detachable pontoon assembly as in claim 11 wherein the saddle is detachable from the upright arm with a quick release comprising a sprung pin.

13. A detachable pontoon assembly as in claim 1 wherein the float further comprises a safety rope intermittently attached around a periphery of a top portion of the float to facilitate holding the float in the event of a capsize.

14. A method of stabilizing a canoe having opposite upper sidewalls comprises the steps of:

providing a pontoon assembly having an arm reception member having opposite end portions, a lateral arm to extend outwardly from the arm reception member, an upright arm to adjustably attach to and extend down from the lateral arm, a saddle attached to a lower end portion of the upright arm; and, an inflatable float secured to and positioned beneath the saddle;

inflating the float beneath the saddle;

attaching the saddle to the upright arm;

removably attaching each end portion of the arm reception member to the upper sidewalls in a central portion of the canoe;

outwardly extending the lateral arm;

attaching and adjusting for height the upright arm on the lateral arm;

so that the canoe is stabilized by the float therealong; and whereafter use the float is deflated, the pontoon assembly is taken apart, and stored within the canoe.

15. A method as in claim 14 wherein the pontoon assembly has one and only one lateral arm extending from the arm reception member and wherein the lateral arm carries a ballast container to resist sudden tipping of the canoe concurrent with lifting of the ballast container, and wherein the method further comprises the step of filling the ballast container with water prior to use, and draining the ballast container after use.

16. A method as in claim 14 wherein the lateral arm is tubular and telescopes outwardly from the arm reception member and wherein the method further comprises the step of releasably clamping the lateral arm at a selected extension.

17. A method as in claim 16 wherein the ballast container comprises a non-elastic foldable shell having a zippered opening and an inner bladder so that the float will have a defined and rigid shape when the bladder is filled.

18. A method as in claim 14 wherein the arm reception member comprises two clamps, each clamp clamping on and over one of the upper sidewalls in a central portion of the canoe.

19. A method as in claim 18 wherein each clamp has opposite side portions which are pinned and buckled together.

20. A method as in claim 19 wherein the upright arm extending downwardly from the lateral arm is adjustably attached thereto with a quick release sprung pin for vertical adjustment of the float to optimize float height with different loads, and with different loads.

* * * * *